United States Patent [19]

Komorowski

[11] 4,176,656

[45] Dec. 4, 1979

[54] NITROGEN-HEAT SEPARATOR FURNACE

[76] Inventor: Alexander F. Komorowski, 69 E. Fourth St., Bayonne, N.J. 07002

[21] Appl. No.: 894,895

[22] Filed: Apr. 10, 1978

[51] Int. Cl.[2] ..... F28D 19/00; F24H 7/00

[52] U.S. Cl. ..... 126/400; 110/322; 126/110 A; 126/116 A; 165/4; 165/10; 165/18

[58] Field of Search ..... 126/400, 285 B, 290, 126/110 A, 116 A; 165/18, 4, 10; 110/322, 326

[56] References Cited

U.S. PATENT DOCUMENTS

| | | | |
|---|---|---|---|
| 2,419,710 | 4/1947 | Di Filippo | 110/322 |
| 2,858,780 | 11/1958 | Sifrin et al. | 110/322 |
| 4,049,404 | 9/1977 | Johnson | 165/4 |

*Primary Examiner*—Samuel Scott
*Assistant Examiner*—Daniel J. O'Connor

[57] ABSTRACT

A furnace having a nitrogen-heat separator comprised of a heat absorbing mass, such as cast iron plates, containing passages through which products of combustion can pass and deposit heat into the metal mass to thereafter be extracted and utilized, a baffle for directing products of combustion through the nitrogen-heat separator, a fiberglass cloth heat-retaining curtain for blocking the furnace exit and trapping heat inside the furnace when fuel combustion stops, a fan for extracting the stored heat from the nitrogen-heat separator when combustion stops and circulating it throughout the furnace interior.

2 Claims, 7 Drawing Figures

NITROGEN-HEAT SEPARATOR FURNACE

BACKGROUND OF THE INVENTION (1) Field of the Invention

This invention deals with a nitrogen-heat separating furnace. More specifically, it relates to a residential heating furnace being made more efficient by means of which it is possible to extract from nitrogen, and then utilize, while still in the furnace, such heat as is normally absorbed by nitrogen during combustion and contained in the nitrogen as it leaves the furnace.

(2) Description of the Prior Art

Heretofore, there have been described in the art various furnaces, but as far as is known there has not been available a simple and easily operated furnace capable of separating heat from nitrogen within the furnace, and one which has no more than three or four moving assemblies.

SUMMARY OF THE INVENTION

According to the present invention, better furnace efficiency can be readily, economically and simply achieved by having within a furnace a nitrogen-heat separator comprised of a heat absorbing mass containing passages through which products of combustion can pass and deposit heat into the metal mass to thereafter be extracted and utilized, a baffle for directing products of combustion through the nitrogen-heat separator, a fiberglass cloth heat-retaining curtain for blocking the furnace exit and trapping heat inside the furnace when fuel combustion stops, a fan for extracting the stored heat from the nitrogen-heat separator when combustion stops and circulating it throughout the furnace interior. Additional features include a furnace-temperature control, plus other features which will become apparent from the following description.

BRIEF DESCRIPTION OF THE DRAWINGS

The invention will be more readily understood by reference to the accompanying drawings in which a preferred embodiment having only four moving assemblies is described, and in which.

DESCRIPTION OF THE PREFERRED EMBODIMENTS

Figure 1:
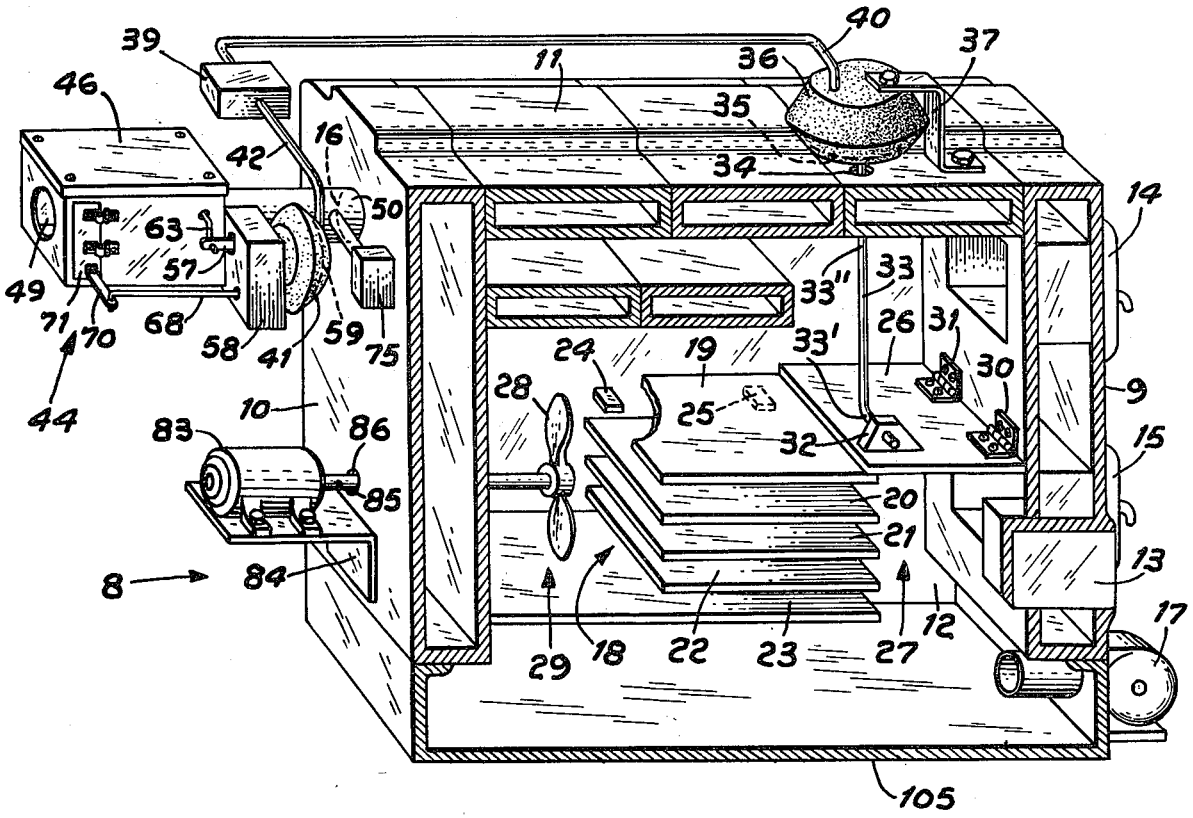
FIG. 1 is a perspective view in which the near side is cut away to expose the inner components of the nitrogen-heat separator furnace of the present invention.

Referring again to the drawings, numeral 8 indicates generally a jacketed enclosure, preferably made of cast-iron and consisting of a front 9, back 10, top 11, and sides 12 and 13 and a base 105. Front 9 has doors 14 and 15 which cover access openings. Oil burner 17 is at the base of front 9.

Nitrogen-heat separator 18, preferably made of cast-iron is comprised of plates 19, 20, 21, 22 and 23, which are spaced apart to form passages for products of combustion to pass through. The plates are supported on cast-in studs, typical of studs 24 and 25, shown supporting one end of top plate 19 (FIG. 1). Top plate 19 is shown partly cut away, to expose stud 24.

Open area below baffle 26 is front gas passage 27. Fan 28 is in rear gas passage 29. Bottom plate 23 extends leftward and abuts inner face of back 10, blocking off bottom of rear gas passage 29. Horizontally positioned baffle 26 blocks off top of front gas passage 27 when left edge rests on right edge of top plate 19 (FIG. 1). Hinges 30 and 31 are screwed to right edge of baffle 26 and also into threaded blind holes at inner face of front 9. Clearance space is necessary between inner faces of enclosure sides 12 and 13 and baffle edges adjacent thereto, to prevent binding of moving baffle when pivoting on hinges 30 and 31.

Baffle 26, preferably made of cast-iron, has on its upper surface, a cast-in boss, which has a pivot hole for receiving hooked end 33' of vertically positioned baffle rod 33. Baffle rod upper end 33" passes through hole 34 in enclosure top 11, and is joined to bottom face of diaphragm partition 35. Diaphragm housing 36 is horizontally secured to top end of support bracket 37 with screws. Lower end of support bracket 37 is secured to top portion of enclosure 8 by screws which enter into threaded blind holes thereat. At times, air-compressor 39, connected to diaphragm housing 36 by tubing 40, forces baffle 26 to take a horizontal (closed) position as in FIG. 1. Vertical movement line of diaphragm partition 35 and baffle rod 33 should be along a common axis which passes through boss 32. A compressed spring (not shown) in lower half of diaphragm housing 36 supplies a lifting force for baffle 26 when the air-compressor stops. The air-compressor is preferably an electric vibrating diaphragm type, mounted as desired.

Curtain housing 44, (FIG. 2) preferably made of sheet metal, forms a furnace exhaust passage. The curtain housing has a front wall 106, back wall 107, top 46, two side walls 108, 109 and a base 110. Top 46 is secured by screws 47. Curtain housing 44 is connected to furnace exhaust port 16 by flue pipe section 50. Furnace exhaust gases pass through openings 48 and 49. One side wall of the curtain housing 44 has an opening 73, shown sealed by draft-diverter door 71. Draft-diverter door 71 seals opening 73 during combustion to facilitate a through-furnace draft. An open draft-diverter is explained below.

Figure 3:
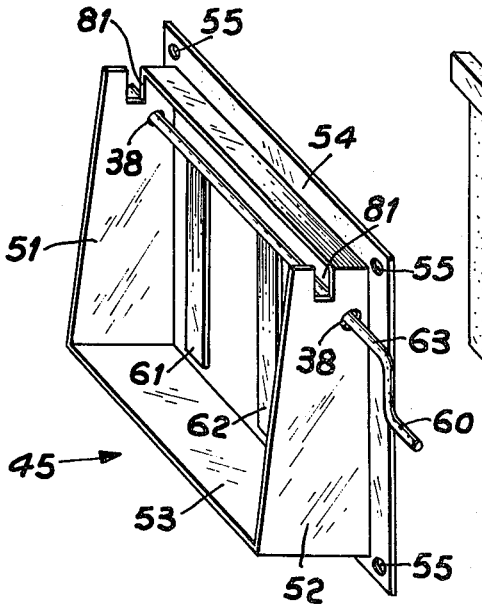
FIG. 3 is a perspective view of a heat seal containing a pair of heat-retaining lifting arms in a retracted position.

The heat seal 45 is within the curtain housing and has sides 51 and 52, and a bottom 53. Free ends thereof form a mouth, which at times, receives arms 61 and 62 (FIG. 3). Heat seal 45 also receives a heat-retaining curtain 43 at times, as in FIG. 5. When in the heat seal 45, the heat-retaining curtain 43 traps heat inside the enclosure 8. Outwardly projecting flanges 54 have holes 55 for screwing the heat seal to the internal right partition of curtain housing 44 and centrally position it about opening 48.

Figure 4:
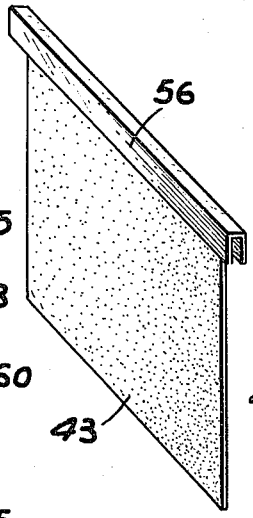
FIG. 4 is a perspective view of a heat-retaining curtain suspended from a support channel.
Figure 5:
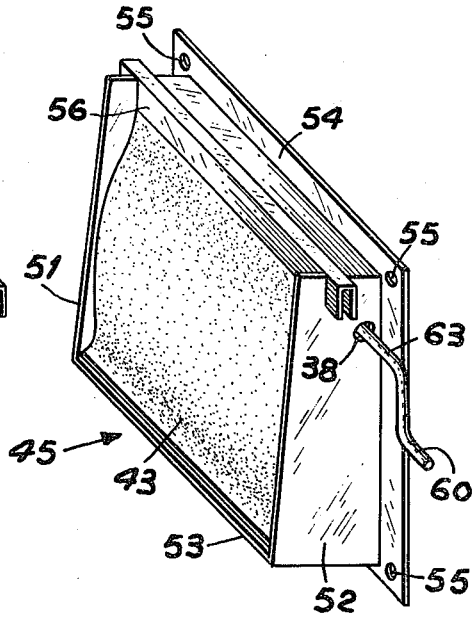
FIG. 5 is a perspective view of the heat-retaining curtain retracted into the heat seal.

Heat-retaining curtain 43, preferably made of non-flammable flexible material, such as fiberglass cloth, hangs inside heat seal 45, as shown in FIG. 5. The upper edge of the heat-retaining curtain 43 is pressed into the support channel 56, as in FIG. 4. Support channel 56 is held horizontally in notches 81 in upper portions of heat seal sides 51 and 52. Channel ends extend outside of heat seal 45.

Figure 2:
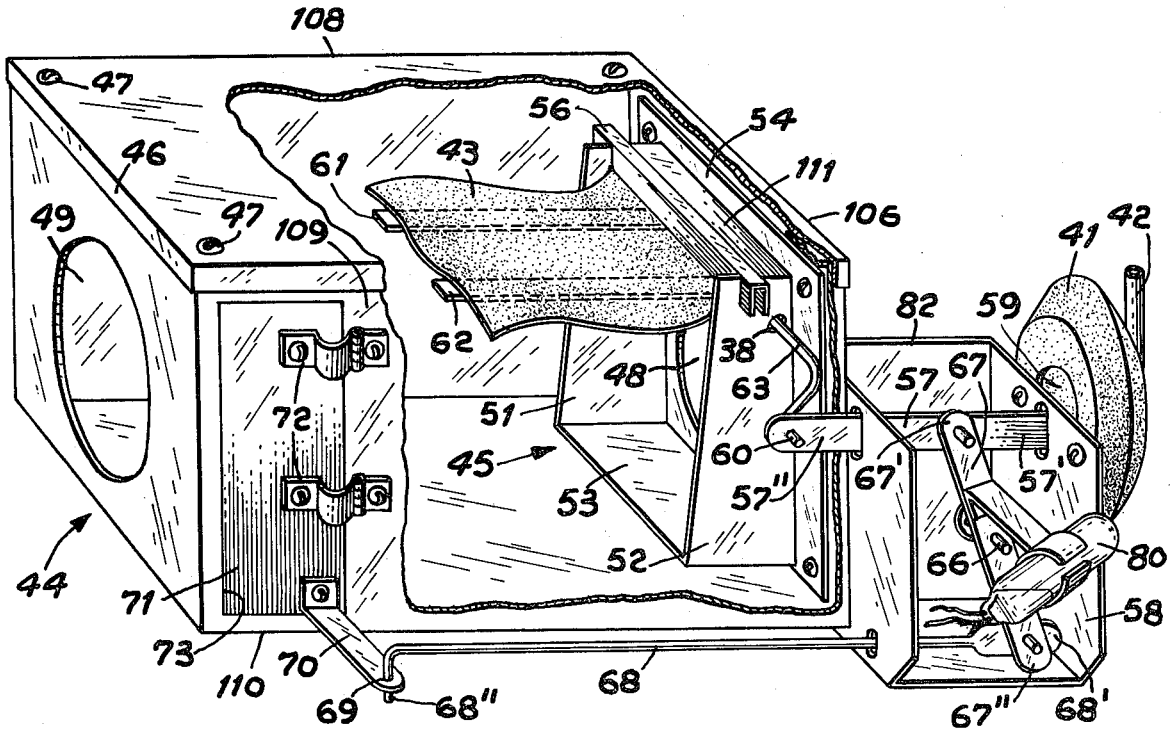
FIG. 2 is a perspective view of the curtain housing cut away at the top and near side, exposing the heat-retaining curtain being held in a horizontal (open) position.

Curtain lifting arms 61 and 62 are welded to a crank shaft 63, and are spaced apart to support heat-retaining curtain 43 in a horizontal position, as shown in FIG. 2. Pivot holes 38 in heat seal sides 51 and 52 offer pivoting means for crank shaft 63 while crank pin stays outside of heat seal 45. Crank pin 60 and arms 61 and 62 share a common plane.

Diaphragm housing 41 connects to air-compressor 39 by tubing 42, and is vertically joined to electric box 58 by screws. Push rod 57 has end 57' joined to diaphragm partition 59, and left end 57'' pivotally engaged to crank pin 60. Pivot pin 66 is firmly joined to rearward partition 82 of electric box 58, and extends forward horizontally, supporting centrally pivoting bar 67. Upper bar end 67' is swivably engaged to right portion of horizontally positioned pushrod 57 while lower bar end 67'' is swivably engaged to end 68' of horizontally positioned pull rod 68. Pull rod hooked end 68'' projects downward into hole 69 of door arm 70. Door arm 70 projects forward horizontally and is joined to draft-diverter door 71 by screws. Leftward moving pull rod 68 causes draft-diverter door to swing into curtain housing on hinges 72, to uncover opening 73 of curtain housing 44. Directional movement line of horizontally movable diaphragm partition 59 and push rod 57 should move along a common axis passing through crank pin 60.

Fan motor 83 is secured at the outside rear of enclosure 8 on support bracket 84. Motor shaft 85 passes through a sleeved opening 86, terminating in rear gas passage 29, and supporting fan 28. Fan rotation pulls air toward itself.

Furnace temperature control 75 is comprised of a bi-metal helix 76, the left end of which is firmly joined to projection 103, and the right end is joined to hooked portion of rod 77 which passes through bearing 95. Rod 77 turns in sleeve 98 to a limited degree. Sleeve 98 is crimp-joined to mercury switch retaining clip 97. Vertical central portion of temperature control arms 78 is rigidly joined to rod 77 at a point between sleeve 98 and bearing 95. Bearing 95 is crimp-joined to partition 102. Forwardly extended upper and lower extensions 78' and 78'', respectively, make right angle turns leftward and have threaded holes at the ends, for receiving temperature adjusting screws 79 and 89. Forward end of mercury switch 74 is spaced between temperature adjusting screws 79 and 89. Spring wire drag brake 99 has right end crimped into slot in bearing 95 while hooked end applies spring pressure in circumferential groove 100. Drag brake 99 holds sleeve and mercury switch, respectively, 98 and 74 steady, while rod 77 is allowed to turn. Base 101 must be horizontally positioned when vertical position 102 is joined to flue section 50, which contains helix 76.

An outside temperature control 104 (FIG. 6) connected to the furnace temperature control 75, is comprised of bellows 90 and receiver 87, connected together by tubing 88 to form a sealed unit. Receiver 87 contains a temperature-pressure related gas, preferably Freon-12, and is exposed to outside temperatures. Bellows 90 is joined to top surface of base 101. Screw 93 projects downward through hole in forward end of upper extension 78' and above bellows 90. Nut 92 facilitates adjusting screw 93. Spring 91 connects eye 94 to screw 93.

Figure 6:
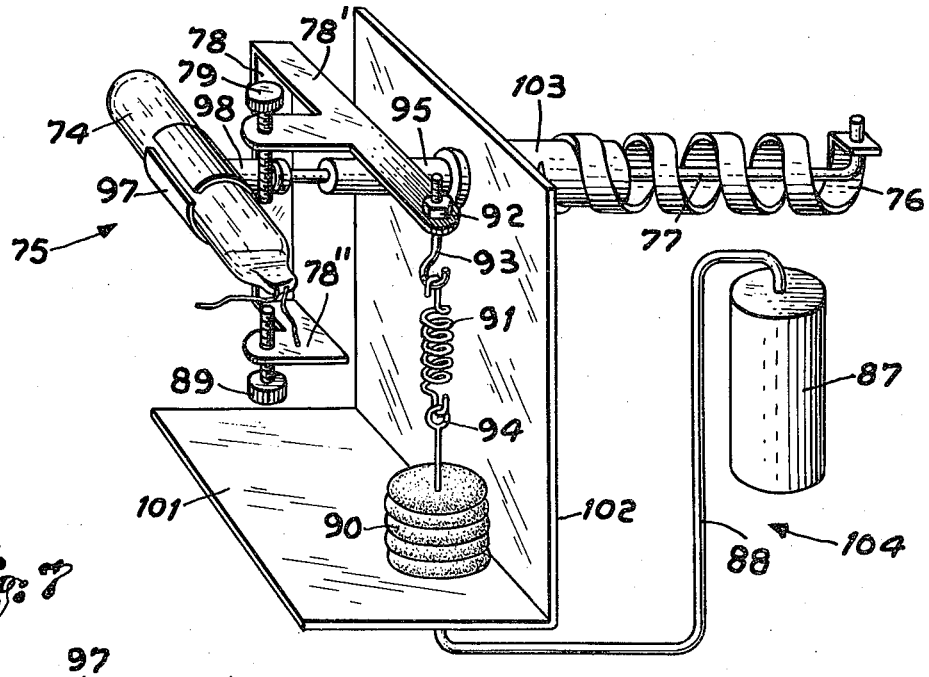
FIG. 6 is a perspective view of a furnace-temperature control mechanism.
Figure 7:
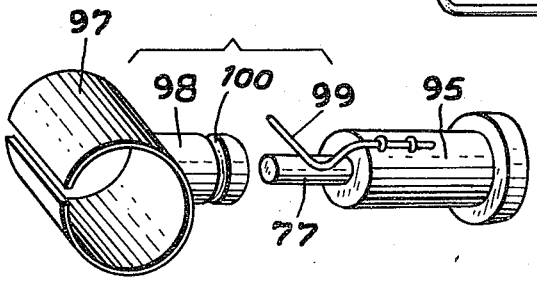
FIG. 7 is a perspective view (exploded) of the mercury switch support portion of FIG. 6. Similar numerals refer to similar parts in the various figures.

The nitrogen-heat separator furnace of the present invention is used as follows: First it is necessary that a conventional thermostat signals for heat and sends an electric current to activate the mercury switch 74 of the furnace temperature control 75 (FIG. 6). Helix portion 76, being in a cold environment, rotates connected rod-arm unit, respectively, 77 and 78 clockwise in limited degree (viewed from mercury switch end) causing upper temperature screw 79 to tilt forward end of mercury switch 74 down to close the circuit. The electric current then goes to a conventional stack relay (not shown).

Next, the stack relay sends the current out in two legs. One leg goes to the open circuit of the mercury safety switch 80, and the other leg activates air-compressor 39. The air-compressor then sends compressed air to two different points. Diaphragm housing 36 receives compressed air through tubing 40 to facilitate movement of baffle 26 (explained below). Diaphragm housing 41 also receives compressed air through tubing 42, to facilitate movement of heat-retaining curtain 43 to an open position (FIG. 2). When the curtain is in an open (horizontal) position, furnace exhaust gases have free passage to the chimney, passing under heat-retaining curtain 43. Lifting of heat-retaining curtain is accomplished when compressed air moves diaphragm partition 59, push rod 57 and crank pin 60 to the left, causing arms 61 and 62 to swing heat-retaining curtain out of heat seal 45 before them.

The draft-diverter door 71 seals opening 73 in curtain housing 44 while the heat-retaining curtain opens. The door 71 must be closed to facilitate through-furnace draft. The door 71 is closed when the top end 67' of centrally pivoting bar 67 moves leftward with push rod 57, causing lower bar end 67'' to move to the right, taking pull rod 68 with it. Pull rod hooked end 68'' thus pulls the draft-diverter door 71 over the opening 73 by means of door arm 70. As the centrally pivoting bar 67 pivots, the attached mercury switch 80 tilts to a closed circuit position (FIG. 2). Electric current then continues through mercury switch 80 to oil burner 17, starting combustion.

As before mentioned, diaphragm housing 41 receives compressed air, diaphragm housing 36 also receives compressed air, forcing diaphragm partition 35, baffle rod 33 and baffle 26 downward, coming to rest on edge of top plate 19, as shown in FIG. 1. As such, products of combustion are directed through nitrogen-heat separator 18, and deposit heat therein.

After passing through the nitrogen-heat separator 18, the somewhat cooler gases move up rear gas passage 29, and then through the remainder of enclosure 8, where some additional heat is absorbed by the heating surfaces therein. The products of combustion then leave enclosure 8 through exhaust port 16, passing helix 76 of the furnace temperature control 75.

With continued combustion, nitrogen-heat separator 18 and helix 76 become progressively and proportionately hotter. In response, helix 76 turns rod-arm unit, respectively, 77 and 78 counter-clockwise (viewed from mercury switch end). As such, lower temperature adjusting screw 89 swings up to tilt mercury switch 74 into an open circuit. Oil-burner 17 and air-compressor 39, thus being denied current, stop functioning when the nitrogen-heat separator reaches the desired and preadjusted temperature setting.

Next, the through-furnace draft is stopped, to prevent heat from going up the chimney. This is done by the heat-retaining curtain which blocks the exhaust port 16. This is accomplished when the compressed air pressure is relieved on diaphragm partition 59, in which case, arms 61 and 62 swing down of their own weight, enter into heat seal 45, bringing heat-retaining curtain 43 with them. When it is within the heat seal 45, the edges of the heat-retaining curtain abut the inner faces of the heat seal 45, sealing in the heat. Downward movement of arms 61 and 62 forces all interconnected linkage to retract, causing draft-diverter door to swing into curtain housing 44 on hinges 72, unblocking opening 73, through which draft pull is diverted and thus prevented from pulling the heat-retaining curtain 43 out of heat seal 45. Bar 67, also retracting, tilts mercury switch 80 to an open circuit position, remaining there until the next combustion period, and until such time the heat-retaining curtain is open, for facilitating through-furnace draft.

Stopping the air-compressor 39 also relieves pressure on diaphragm partition 35, allowing a compressed spring (not shown) in lower half of the diaphragm housing 36 to lift diaphragm partition 35 and connected baffle rod 33 upward on hinges 30 and 31. The front gas passage 27 is thus unblocked to facilitate circulation through the enclosure.

Fan 28 begins rotating when combustion stops, and pulls air through the nitrogen-heat separator 18, where it absorbs heat. The hot air is then forced up the rear gas passage 29, across the top of the nitrogen-heat separator 18, and then down the front gas passage 27 through the open baffle for recirculation. During circulation, the air gives up its heat to the furnace heating surfaces.

As the nitrogen-heat separator gives up heat, temperatures at the helix 76 drop also. In reacting, helix 76 turns rod-arm unit, respectively, 77 and 78 clockwise a limited degree (viewed from mercury switch end), while mercury switch 74 is held steady in an open circuit position by drag brake 99. Upper temperature adjusting screw 79 then forces the mercury switch 74 downward to a closed circuit position for another combustion cycle if the thermostat is not yet satisfied. If at that time the thermostat is satisfied, the instrument's connected relay will shut down the system.

As outside temperatures grow colder, temperatures at the nitrogen-heat separator 18 are automatically raised to facilitate thermostat satisfaction. In accomplishing this, receiver 87, located outside the home and containing Freon-12 exposed to the outside temperatures, creates lesser pressures in colder temperatures within the receiver 87 and bellows 90. Bellows 90 contract with the lesser pressures, pulling down on spring 91 which resists upward movement of upper arm end 78' thereat as well as the twisting turning motion of the helix 76. As such, helix 76 then requires greater temperatures to overcome progressively more resistance and consequently allowing the nitrogen-heat separator to reach higher temperatures in relation to colder outside temperatures.

Although the drawings illustrate a nitrogen-heat separator furnace in which the nitrogen-heat separator is comprised of flat plates, and in which passages run horizontally between the plates, it is apparent that other shapes, pipe, for example, could be used, and that the passages need not necessarily run horizontally, angularly, curved, or vertically, for example. The essential feature, however, is that products of combustion be offered passages through which to pass and a heat conductive mass into which heat can be deposited.

Also, although the drawings illustrate an oil-burner, it is apparent that a gas burner could be employed. The essential feature, however, is that any combustion producer could be employed.

Also, although the drawings illustrate a fan positioned inside the enclosure, it is apparent the fan could be outside the enclosure and encased in ducts leading to the enclosure interior. The essential feature, however, is that a fan be used to move air through the nitrogen-heat separator and to circulate air throughout the enclosure.

Also, although the drawings illustrate a jacketed enclosure for containing water, it is apparent that the enclosure could be jacketed to contain air. The essential feature, however, is that the enclosure, if jacketed at all, contain a home heating media, and if replaced by insulation and a tank installed inside the enclosure, the home heating aspect can be converted into a domestic hot water heater, and thus expressed as an enclosure having heating surfaces therein.

I claim:

1. A nitrogen heat separator furnace comprising:

(a) an enclosure having a front, back, top, sides and a base and formed with doors on the front for access to the interior of the enclosure;

(b) a fuel burner mounted in the enclosure;

(c) a furnace temperature control;

(d) an outside temperature control electrically connected to the furnace temperature control to activate the furnace temperature control when outside temperatures fall to a predetermined level;

(e) a plurality of heat absorbing elements containing passages mounted in the central area of the enclosure inward from the front and back walls to provide a front gas passage and rear gas passage for hot gas flow around the heat absorbing elements and through the elements;

(f) a fan operatively mounted at the rear of the enclosure to circulate the heated gas through the enclosure when the fuel burner stops operating;

(g) a baffle movably mounted on the inner face of the front wall being of a predetermined size to extend horizontally from the front wall to the top front edge of the heat absorbing elements and between the side walls;

(h) a baffle rod mounted on the upper face of the baffle;

(i) an exhaust port formed in the upper part of the wall of the enclosure;

(j) a flue pipe connected to and extending outwardly from the exhaust port;

(k) a curtain housing mounted outside of the enclosure at the end of the flue pipe, the curtain housing having a front wall formed with an opening to contain the end of the flue pipe, a back wall formed with an opening leading to a chimney, a top, two side walls and a base;

(1) a movably mounted draft-diverter door being formed in one side wall, said door being closed during the fuel combustion phase of operation of the furnace;

(2) moving means attached to the draft-diverter door;

(3) a heat seal formed inside the front wall, the seal being a frame having a top, two sides and a base, the frame being affixed against the front wall of the curtain housing with its opening surrounding the opening to the flue pipe;

(4) a support channel mounted horizontally across the center of the top of the heat seal;

(5) a heat retaining curtain of inflammable flexible material affixed into the support channel and covering the opening of the frame;

(6) a crank shaft movably mounted through the top of the heat seal between the heat retaining curtain and the front edge of the heat seal, the crank shaft being formed with two downwardly extending arms spaced to lift the heat retaining curtain up into the curtain housing;

(7) pivot connection means operably connected to the shaft and to the pull rod attached to the draft-diverter door to simultaneously raise the arms of the shaft lifting the heat retaining curtain and close the draft-diverter door and thereafter to simultaneously lower the arms of the shaft and open the draft-diverter door;

(8) electronic switching means connected to the pivot connection means;

(l) an air compressor;

(m) tubing;

(n) two diaphragm housings, each having a diaphragm partition, each housing being connected to the air compressor by tubing, one diaphragm housing being connected to the baffle rod attached to the baffle and the second diaphragm housing being attached to the pivotal connection means of the curtain housing; and (o) an electrical stack relay operatively connected to the furnace temperature control and outside temperature control and formed to send out current in two legs, one leg being connected to the electronic switching means which is operatively connected to the pivotal connection means of the curtain housing and the second leg connected to activate the air compressor, whereby when the thermostat control is activated, the air compressor will operate to force compressed air into the two diaphragms, one diaphragm forcing down the baffle rod within the enclosure so that the baffle will be down and hot air will be directed into the heat absorbing elements and the second diaphragm moving the pivot connection means connected to the curtain housing, raising the heat retaining curtain, closing the draft diverting door and closing the pivot control switch, which closes the electrical circuit within the furnace to activate the oil burner; when the thermostat has been satisfied the circuit is broken, the air compressor stops, the pivot connection means reverse, the heat retaining curtain falls, the draft diverter door opens to provide a through furnace draft and the pivot control switch opens.

2. A nitrogen heat separator furnace as set out in claim 1 in which (a) the heat absorbing elements are cast iron plates; and (b) the heat retaining curtain is made of fiberglass cloth.

* * * * *